US009963907B2

(12) United States Patent
Jeong et al.

(10) Patent No.: US 9,963,907 B2
(45) Date of Patent: May 8, 2018

(54) INNER BODY FIXING DEVICE OF DOOR LOCK

(71) Applicant: SAMSUNG SDS CO., LTD., Seoul (KR)

(72) Inventors: Jin Jeong, Seoul (KR); Sang-Han Lee, Gunpo-si (KR)

(73) Assignee: SAMSUNG SDS CO., LTD., Seoul (KR)

( * ) Notice: Subject to any disclaimer, the term of this patent is extended or adjusted under 35 U.S.C. 154(b) by 564 days.

(21) Appl. No.: 14/630,043

(22) Filed: Feb. 24, 2015

(65) Prior Publication Data

US 2016/0115709 A1 Apr. 28, 2016

(30) Foreign Application Priority Data

Oct. 24, 2014 (KR) ..... 10-2014-0145462

(51) Int. Cl.
*E05C 3/16* (2006.01)
*E05B 9/08* (2006.01)

(52) U.S. Cl.
CPC ..... *E05B 9/08* (2013.01)

(58) Field of Classification Search
CPC ... Y10T 292/85; Y10T 292/57; Y10T 292/91; Y10T 70/5761; Y10T 292/88; Y10T 70/5832; Y10T 292/1053; E05B 15/02; E05B 1/003; E05B 9/002; Y10S 292/31; Y10S 292/02; Y10S 292/30; E05C 1/145
USPC ..... 292/336.3, 221, 356, 357, 347, 348
See application file for complete search history.

(56) References Cited

U.S. PATENT DOCUMENTS 4,789,191 A * 12/1988 Dennis ..... E05B 3/06 292/1
4,838,054 A * 6/1989 Weinerman ..... E05B 9/08 292/227
4,986,583 A * 1/1991 Campbell ..... E05L 365/104 292/165
5,046,340 A * 9/1991 Weinerman ..... E05B 9/08 292/227
2006/0261608 A1* 11/2006 Rusiana ..... E05C 1/14 292/336.3
2012/0073084 A1* 3/2012 Lin ..... E05L 33/00 16/412

FOREIGN PATENT DOCUMENTS

KR 10-0554703 B1 2/2006
KR 10-0649453 B1 11/2006
KR 10-1008818 B1 1/2011
KR 10-1384809 B1 4/2014

* cited by examiner

*Primary Examiner* — Mark A Williams
(74) *Attorney, Agent, or Firm* — Sughrue Mion, PLLC

(57) ABSTRACT

Provided is an inner body fixing device of a door lock. The inner body fixing device includes a first fixing part fixed on a surface of a door; a third fixing part coupled to the first fixing part; and a second fixing part provided between the first fixing part and the third fixing part and coupled to an inner body of the door, wherein a first coupling part of the first fixing part and a second coupling part of the third fixing part are configured to couple to each other, and the third fixing part is coupled to the second fixing part by a fixing member.

10 Claims, 6 Drawing Sheets

INNER BODY FIXING DEVICE OF DOOR LOCK

CROSS-REFERENCE TO RELATED APPLICATION

This application claims priority under 35 U.S.C. § 119 to Korean Patent Application No. 10-2014-0145462 filed on Oct. 24, 2014, the disclosure of which is hereby incorporated by reference in its entirety.

BACKGROUND

Field

Embodiments of the inventive concept relate to an inner body fixing device of a door lock, and more particularly, to an inner body fixing device of a door lock having a simple structure with which an inner body of a door lock can be assembled conveniently and quickly due to coupling strength of members, and convenience of door lock installation can be improved due to the capability of firm assembly without misalignment.

Description of Related Art

In general, a door lock or a safe is used in a home, an office, and a shop for crime prevention and security. Recently, use of digital door locks and digital safes that are used by entering a password has expanded due to threats to the safety of mechanical door locks and mechanical safes.

Particularly, a digital door lock, which has a password input method, includes an indoor unit and an outdoor unit installed to face each other on an inside and outside of a door, respectively, an inner body installed on the inside of the door, and an outer body installed on the outside of the door, and the inner body and outer body are fixed by a base type bracket coupled to the door.

Here, in general, driving units such as open and close buttons, a compulsory lock button, a hand lever, a battery, and an inner lever are installed on an inside of a door lock.

In addition, key buttons configured to enter numerals and special characters for opening a door, and an outer lever are included at outside of a door lock When a user wants to open a door which has a door lock mounted thereon, a locked state may be unlocked using a key button of a door lock mounted on an outside of the door by pushing a sequence of buttons corresponding to a preset combination of numerals and special characters.

A door lock disclosed in the prior art is configured of an outer body coupling structure of a digital door lock in which inner body and an outer body are coupled respectively on an inner plate and on an outer plate of a bracket, a rotating member having gears formed on an outer surface thereof is rotatably coupled to the outer plate, gears are formed on both sides of the rotating member to move vertically with rotation of the rotating member, a first elevating member and a second elevating member are engaged with the gears, and ends of the first elevating member and the second elevating member are inserted into or released from a coupling part formed on the outer body to fix the outer body to the outer plate or separate the outer body from the outer plate.

However in this door lock of the prior art, when the inner body of the door is assembled using a plurality of fastening members, there are many parts and a structure is complex, and when the inner body of the door lock is assembled using a fastening parts such as screws, an arbitrary torque value is applied according to an installer's experience, and thus the door lock may be misaligned with the door if balance is not maintained between the plurality of fastening parts, and the door lock may operate abnormally or break.

Korea Patent Application Laid-Open No. 2014-0027788.

SUMMARY

Embodiments of the inventive concept are configured to solve a problem of a prior art by providing an inner body of a door lock having a simple structure with which an inner body of a door lock can be assembled conveniently and quickly due to coupling strength of members, and convenience of door lock installation can be improved due to the capability of firm assembly without misalignment.

The technical objectives of the inventive concept are not limited to the above disclosure; other objectives may become apparent to those of ordinary skill in the art based on the following descriptions.

In accordance with one aspect of the inventive concept, an inner body fixing device of a door lock includes a first fixing part installed and fixed on one surface of a door, a third fixing part coupled to the first fixing part, and a second fixing part located between the first fixing part and the third fixing part and coupled to an inner body, wherein a first coupling part is formed in the first fixing part and a second coupling part for coupling the first coupling part is formed in the third fixing part, and the first coupling part is coupled and fixed to the second coupling part by a fixing member.

In an embodiment, a first fastening part may be formed on the first coupling part or the second coupling part.

In another embodiment, the first fastening part may be an inlet hole or an inlet groove formed in the first coupling part, and the second coupling part may be an inlet protrusion.

In still another embodiment, the first fastening part may be an inlet hole or an inlet groove formed in the second coupling part, and the first coupling part may be an inlet protrusion.

In yet another embodiment, the third fixing part may have a ring-shaped structure configured to cover an edge surface of the second fixing part.

In yet another embodiment, a second fastening part for fastening the fixing member may be formed on a lower end of the second fixing part.

In yet another embodiment, a third fastening part for fastening the fixing member may be formed on a lower end of the third fixing part.

In yet another embodiment, the second fixing part may have a mounting part on another side thereof.

In yet another embodiment, an elastic member may be coupled to the fixing member.

BRIEF DESCRIPTION OF THE DRAWINGS

The foregoing and other features and advantages of the inventive concepts will be apparent from the more particular description of preferred embodiments of the inventive concepts, as illustrated in the accompanying drawings in which like reference characters refer to the same parts throughout the different views. The drawings are not necessarily to scale, emphasis instead being placed upon illustrating the principles of the inventive concepts. In the drawings.

DETAILED DESCRIPTION OF THE EMBODIMENTS

Advantages and features of the inventive concept, and methods of achieving the same will be clearly understood with reference to the accompanying drawings and the following detailed embodiments. When it is determined that detailed explanations of related well-known functions or configurations unnecessarily obscure the gist of the embodiments, the detailed description thereof will be omitted. Terms described below are selected by considering functions in the embodiment and meanings may vary depending on, for example, a user or operator's intentions or customs.

However the inventive concept may be embodied in many different forms and should not be construed as being limited to the embodiments set forth herein. Rather, these embodiments are provided so that this disclosure will be thorough and complete, and will fully convey the inventive concept to those of ordinary skill in the art. The inventive concept is defined by the appended claims. Therefore, the meanings of terms should be interpreted based on the scope throughout this specification.

Throughout this specification, when a certain part "includes" a certain component, unless clearly stated otherwise, it does not imply that any other components are excluded, and other components may also be included.

Figure 1:
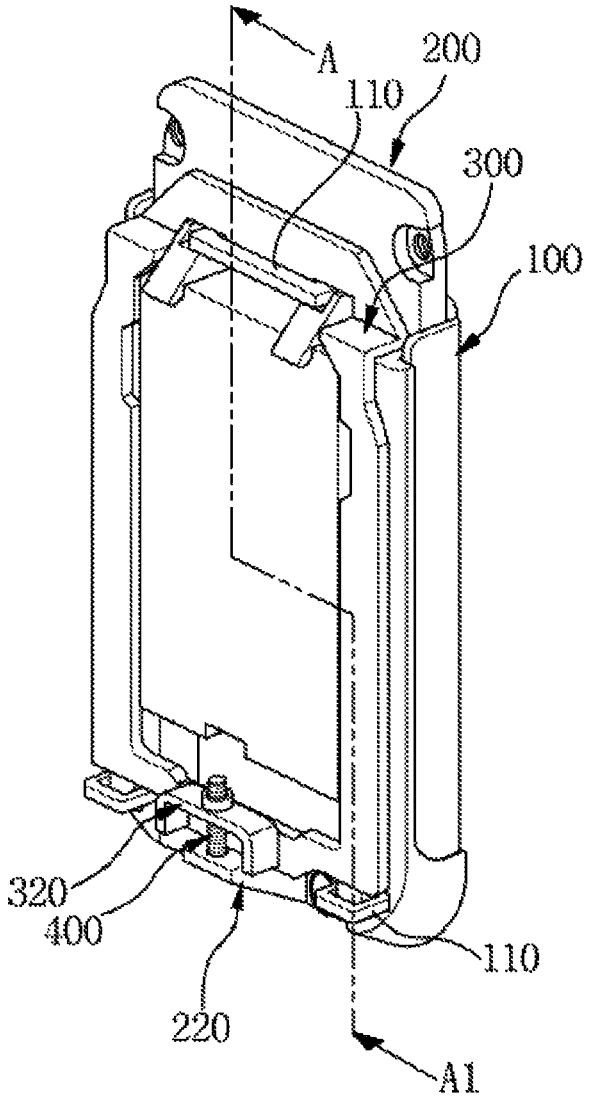
FIG. 1 is a perspective view illustrating a coupled state of an inner body fixing device of a door lock according to an embodiment of the inventive concept.
Figure 2:
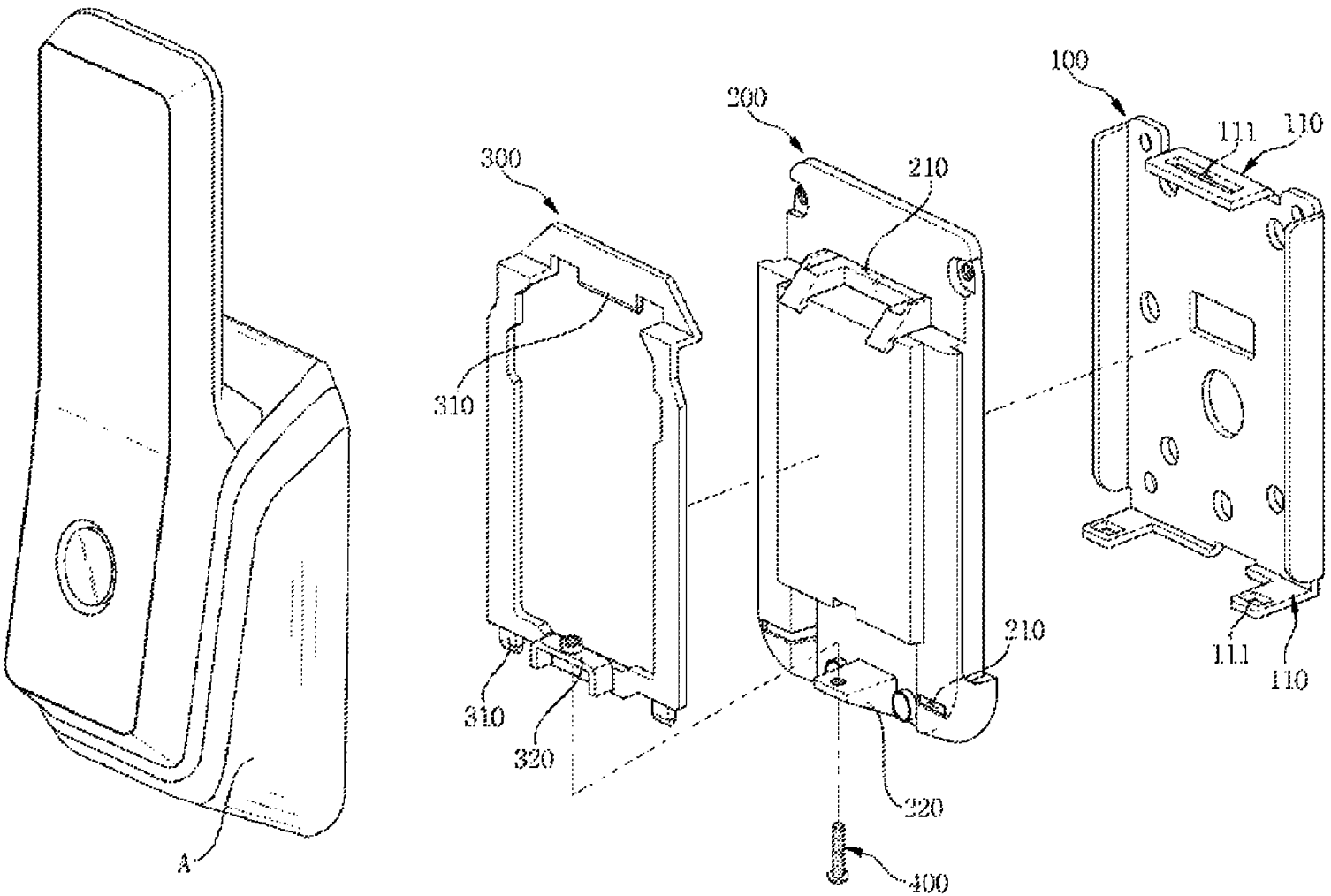
FIG. 2 is an exploded perspective view illustrating an exploded state of the inner body fixing device of a door lock according to an embodiment of the inventive concept.
Figure 3:
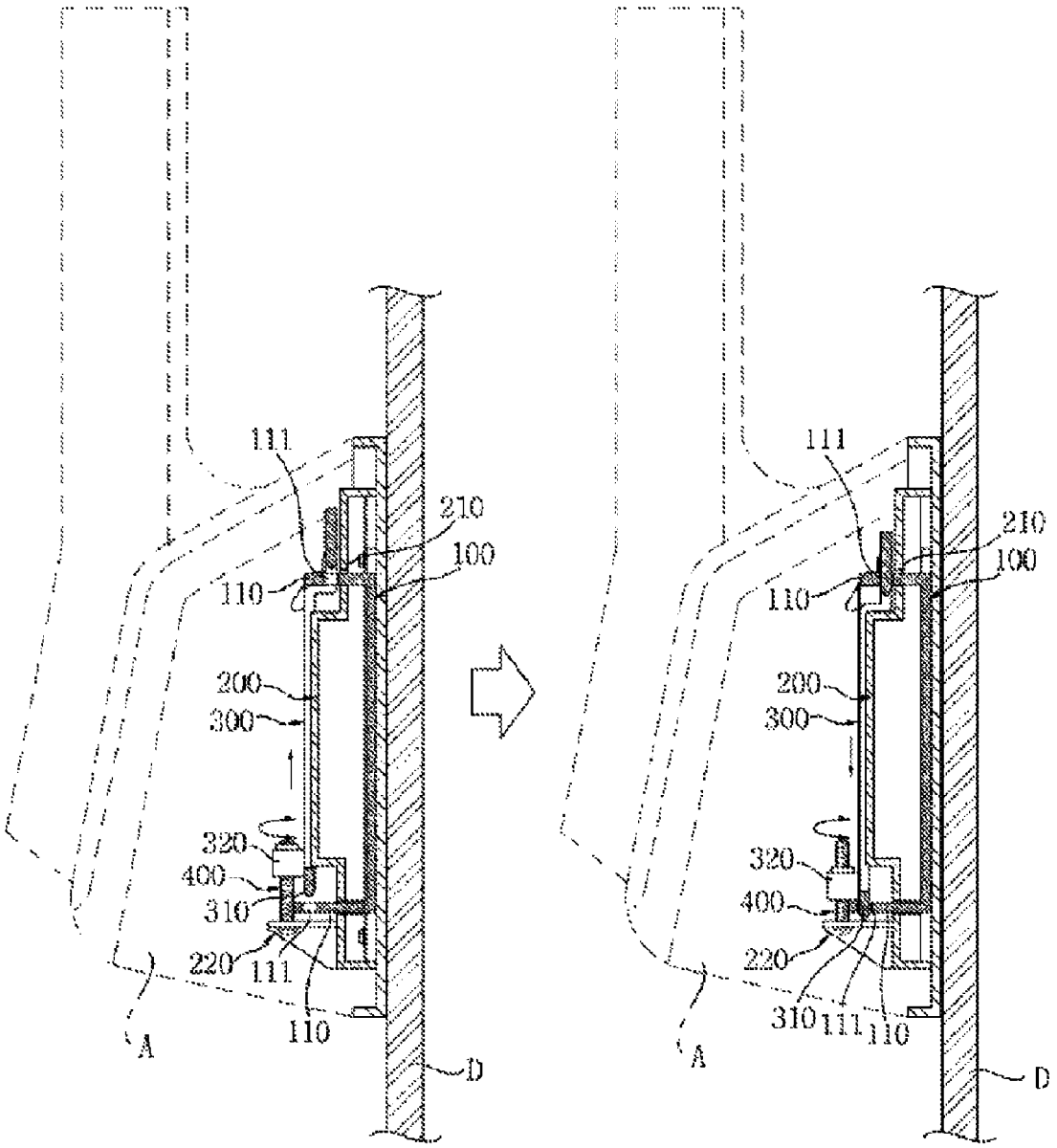
FIG. 3 is a side sectional view taken along line A-A1 of an inner body fixing device of a door lock according to an embodiment of the inventive concept.
Figure 4:
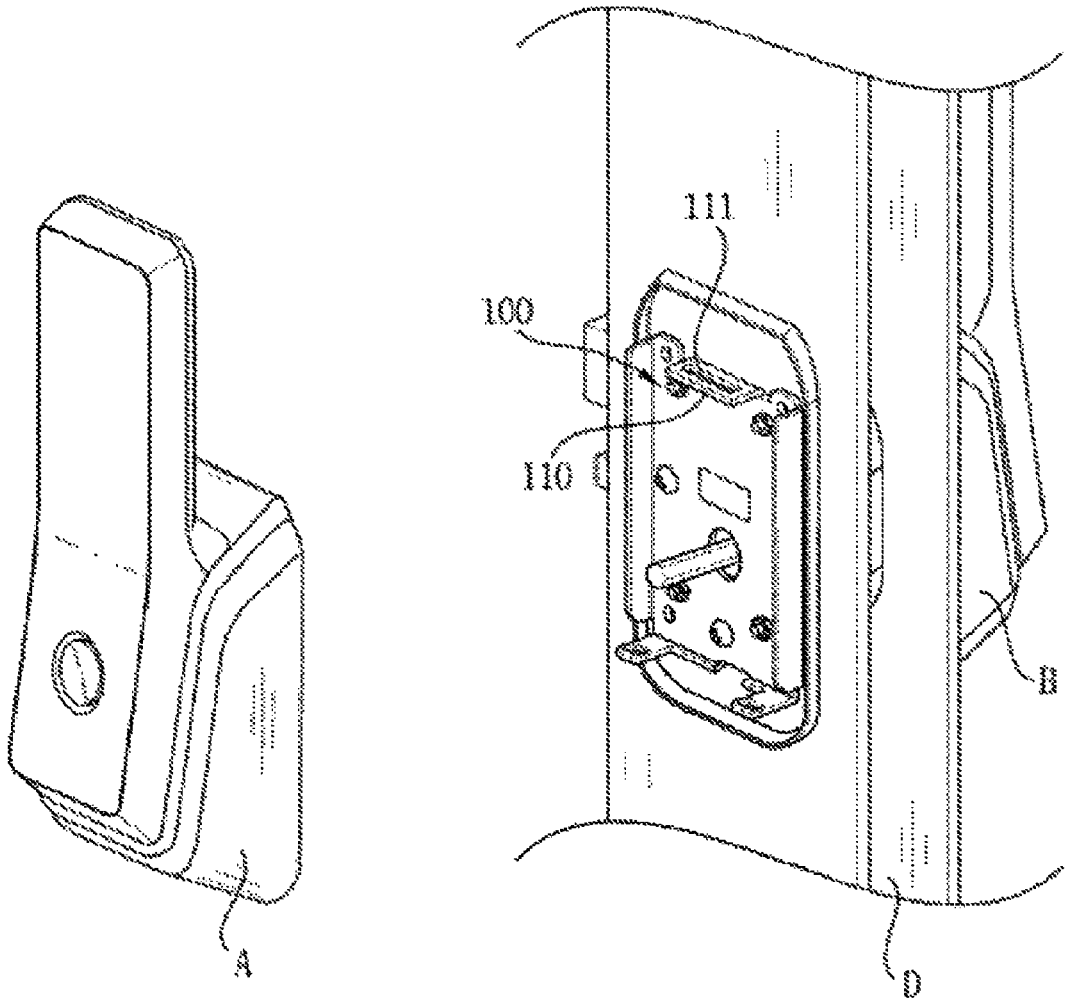
FIG. 4 is a rear view illustrating an inner body fixing device of a door lock according to an embodiment of the inventive concept.
Figure 5:
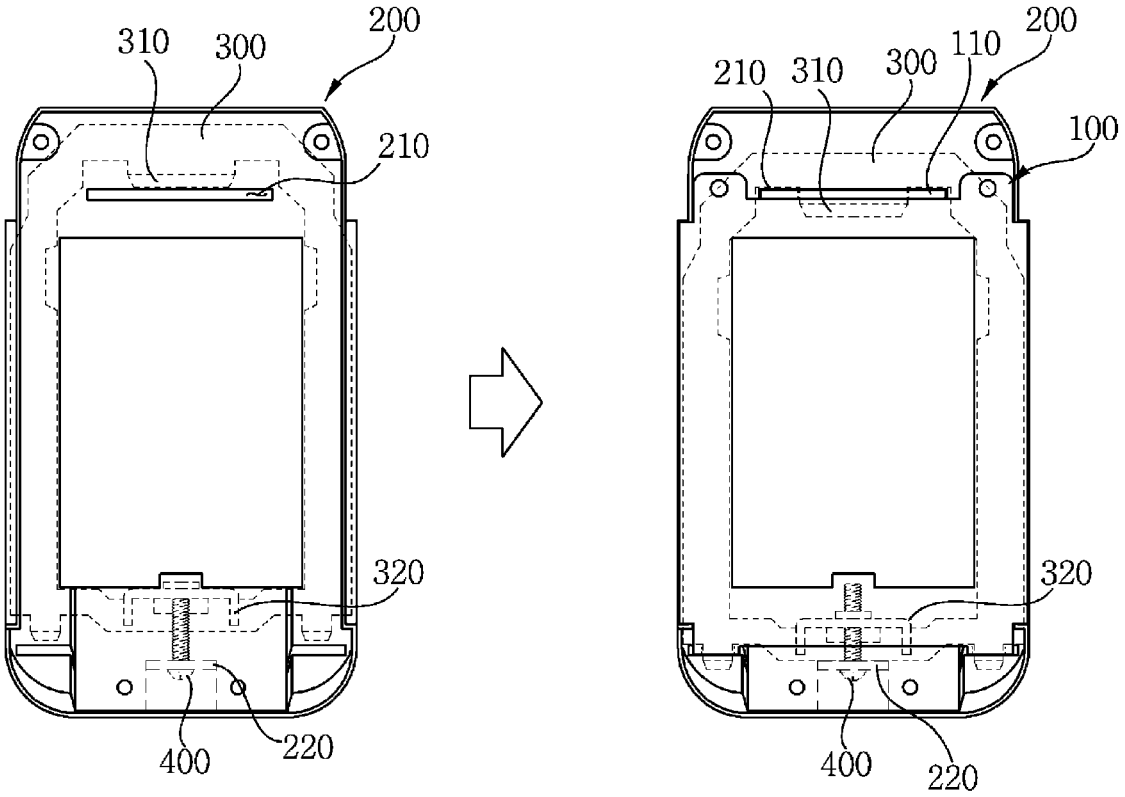
FIG. 5 is an exemplary view illustrating a state in which an inner body fixing device of a door lock according to an embodiment of the inventive concept is separated from a door.

Hereinafter, a structure and effects of an inner body fixing device of a door lock according to an embodiment of the inventive concept will be described in more detail with reference to the attached drawings. FIG. 1 is a perspective view illustrating a coupled state of the inner body fixing device of a door lock according to an embodiment of the inventive concept, FIG. 2 is an exploded perspective view illustrating an exploded state of the inner body fixing device of a door lock according to an embodiment of the inventive concept, FIG. 3 is a side sectional view taken along line A-A1 of the inner body fixing device of a door lock according to an embodiment of the inventive concept, FIG. 4 is a rear view illustrating the door lock inner body according to an embodiment of the inventive concept, and FIG. 5 is an exemplary perspective view illustrating a state in which the inner body fixing device of a door lock is separated from a door D according to an embodiment of the inventive concept.

As illustrated in drawings, the inner body fixing device of a door lock in accordance with an embodiment of the inventive concept includes a first fixing part 100 installed and fixed on one surface of a door D, a third fixing part 300 coupled with the first fixing part 100, a second fixing part 200 coupled with an inner body A located between the first and third fixing parts 100 and 300, and a fixing member 400 fastening and fixing the second fixing part 200 and the third fixing part 300.

The first fixing part 100 installed and fixed on the one surface of the door D firmly fixes the second fixing part 200 by covering a second surface and the side surfaces of the second fixing part 200, and simultaneously serves to provide simple and convenient coupling to the third fixing part 300.

The first fixing part 100 is formed in a plate shape to cover the side surfaces of the second fixing part 200. Preferably, one surfaces of top and bottom end parts of the first fixing part 100 are formed in a shape that surrounds a second surface and side surfaces of the second fixing part 200. The first fixing part 100 is fixed on the one surface of the door D through screw coupling, and first coupling parts 110 are formed on one surfaces of the top and bottom end parts of the first fixing part 100.

Here, the first coupling parts 110 protrude in one direction on the top and bottom ends of the one surface of the first fixing part 100 so that end parts thereof pass through and are exposed to one surface of the second fixing part 200.

The first coupling parts 110 include a first fastening part 111 with which a second coupling part 310 of the third fixing part 300 to be described below is fastened.

Here, the first fastening part 111 is not illustrated in this drawing, but may be formed on the second coupling part 310 as a protrusion of the second coupling part 310 from the third fixing part 300.

The first fastening parts 111 may be one of inlet holes, inlet grooves, and inlet protrusions. The second coupling part 310 may be formed as an inlet protrusion when the first fastening parts 111 are one of inlet holes or inlet grooves formed on the first coupling part 110. The first coupling part 110 may be formed as an inlet protrusion when the first fastening parts 111 are one of inlet holes or inlet grooves formed on the second coupling part 310. However, the inventive concept is not limited thereto, and the first fastening parts 111 may be formed in various ways as long as a structure of a male-female coupling relation is maintained.

The first coupling parts 110 are formed at an equal interval on a lower end of the one surface of the first fixing part 100, and may preferably be disposed thereon spaced apart from each other in both side directions on the lower end of the one surface of the first fixing part 100.

The third fixing part 300 is conveniently and quickly assembled by a fixing member 400 and serves to improve convenience through firm assembly without misalignment when the door lock is installed.

The third fixing part 300 is formed to protrude from the second coupling part 310, the top and bottom of which are fastened with each of the first fastening parts 111 of the first coupling part 110, i.e., are formed as inlet protrusions when the first fastening parts 111 are inlet holes or inlet grooves, and includes a third fastening part 320 having a fastening hole formed at the lower end configured to be fastened by the second fixing part 200 and the fixing member 400.

Here, the second coupling part 310 is formed to extend downward from top and bottom end parts of the third fixing part 300 to be coupled vertically to the ends of the first coupling part 110 exposed on one surface of the third fixing part 300, and is preferably formed to extend downward from an upper surface of the first coupling part 110 to top and bottom end parts of the third fixing part 300 to be coupled through the first fastening part 111.

The third fastening part 320, which is formed on the lower end of the third fixing part 300, preferably includes a fastening hole formed therethrough to be coupled by a second fastening part 220 of the second fixing part 200 to be described below and the fixing member 400.

Here, a screw hole for fastening the fixing member 400 so that the third fixing part 300 and the second fixing part 200 are coupled by the fixing member 400 is formed in the fastening hole.

The second fixing part 200, which is mounted on the one side of the first fixing part 100 so that the side surfaces and a second surface are covered by the first fixing part 100, is normally coupled to the inner body A of the door lock having a unit for driving the door lock, and serves to firmly fix the third fixing part 300 using the one fixing member 400.

The second fixing part 200 includes a mounting part 210 formed as a hole or groove in the upper end so that the first coupling part 110 of the first fixing part 100 is exposed on one surface by passing through the other surface, and the second fastening part 220 in which the fastening hole is formed so that the second fixing part 200 is fastened by the third fixing part 300 and the fixing member 400 formed on the lower end.

Here, when the first fixing part 100 and the second fixing part 200 are mounted, the mounting part 210 is formed to pass from one surface to the other surface of the second fixing part 200 so that the end parts of the first coupling part 110 pass from one surface to the other surface of the second fixing part 200, and is exposed through the one surface of the second fixing part 200 to be coupled.

The second fastening part 220, which is coupled by the third fastening part 320 and the fixing member 400, is preferably formed to protrude along the same vertical center line as the third fastening part 320 formed on the lower end of the one surface of the third fixing part 300.

The fixing member 400 generally includes a screw or a bolt, but is not limited thereto, and any known fastening method having a screw thread or a fastening method having a plate spring may be used.

According to embodiments of the inventive concept, first, when an outer body B serving as an outer part of door lock is installed on an outer surface of a door D, a first fixing part 100 is fixedly installed on the outer surface of the door, and then a second fixing part 200 is mounted so that a first coupling part 110 on one surface of the first fixing part 100 is inserted through a mounting part 210 of the second fixing part 200, and the end parts of the first coupling part 110 are exposed through the one surface the second fixing part 200.

Next, a third fixing part 300 is in contact with one surface of the second fixing part 200 so that a second fastening part 220 and a third fastening part 320 are positioned on the same center line, and a second coupling part 310 of the third fixing part 300 is simultaneously inserted into a first fastening part 111 of the first coupling part 110 which is exposed through one surface the second fixing part 200.

Thus, because the second coupling part 310 is inserted into the first fastening part 111 of the first coupling part 110 and fastened, balance for fastening a fixing member 400 to the second fastening part 220 and the third fastening part 320 may be adjusted easily.

Next, when the fixing member 400 is fastened to the second fastening part 220 and the third fastening part 320, depending on a state of tightening or fastening of the fixing member 400, the second fixing part 200 and the third fixing part 300 are firmly fixed by the third fixing part 300 while sliding according to the state of progress of tightening or fastening of the fixing member 400, and the second coupling part 310 may be inserted and firmly coupled to the first fastening part 111 of the first coupling part 110 depending on the sliding of the third fixing part 300.

In other words, when the second coupling part 310 having an inlet protrusion is inserted into the first fastening part 111 having an inlet hole or an inlet groove, the coupled state between the first coupling part 110 having the first fastening part 111 and the second coupling part 310 may remain firmly fixed through the fixing member 400 which is fastened to the second and the third fastening parts 220 and 320 of the second fixing part 200 and the third fixing part 300.

Therefore, the second fastening part 220 and the third fastening part 320 are coupled by the one fixing member 400, the second fixing part 200 and the third fixing part 300 are firmly coupled by tightening or fastening of the fixing member 400, and the first fastening part 111 of the first coupling part 110 and the second coupling part 310 are simultaneously coupled in a male-female form by the sliding of the third fixing part 300, and as a result, the first, second, and third fixing parts 100, 200, and 300 remain firmly coupled to one another using the one fixing member 400, and because coupling can be performed with the one fixing member 400 upon installation, balance is easy to maintain, thus preventing misalignment and providing convenience in installation.

Figure 6:
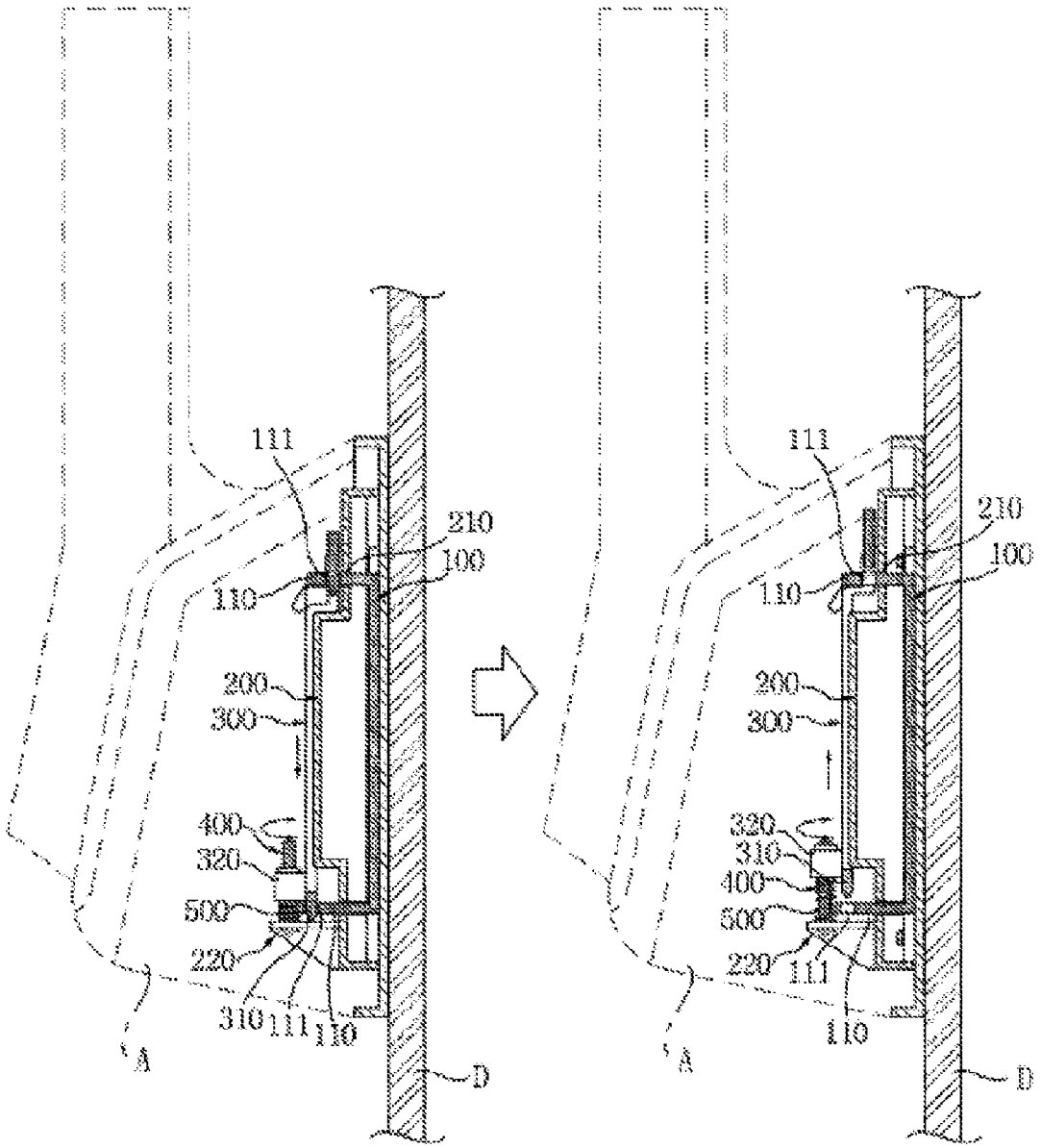
FIG. 6 is a cross-sectional view illustrating a state in which an elastic member is applied to a fixing member of the inner body fixing device of a door lock according to an embodiment of the inventive concept.

Meanwhile, the attached FIG. 6 illustrates another embodiment of the inventive concept in which an elastic member 500 is applied to the fixing member 400, and the sliding is guided by compression or expansion of the elastic member 500 when the fixing member 400 is pressurized or unfastened using a tool, for example, a driver. Hereinafter, the same parts as those described in FIG. 1 to FIG. 5 according to embodiments of the inventive concept are given the same reference numerals and repeated description is omitted.

This embodiment of the inventive concept, as described above, has a simple structure with which an inner body of a door lock can be assembled conveniently and quickly using one fastening part, and firmly without misalignment, and thus improves convenience of installation, and has an effect of improving the appearance and simplicity by using one fastening member to couple the parts in order to minimize the number of fastening holes, as well as minimizing the number of externally visible fastening holes.

The inner body fixing device of a door lock according to the embodiment of the inventive concept improves convenience of door lock installation due to its simple structure which can be assembled conveniently and quickly due to coupling strength of members and can be assembled firmly without misalignment.

Furthermore, embodiments of the inventive concept provide improvements in appearance and simplicity by using only one screw to couple the parts, thereby minimizing the number of fastening holes, as well as minimizing the number of externally visible fastening holes.

An inner body fixing device of a door lock according to embodiments of the inventive concept can be easily applied in the field of improving convenience of door locks through convenient and quick assembly of an inner body of a door lock using coupling strength of members, and firm assembly of the door locks without misalignment, and improving appearance and simplicity by using one screw to couple the parts in order to minimize the number of fastening holes, as well as minimizing the number of externally visible fastening holes.

While embodiments of the inventive concept have been described above, it will be understood by those of skilled in the art that various changes and alternations in form and details may be made by adding, changing, or eliminating elements without departing from the spirit and scope of the inventive concept, therefore, these will be construed as being included in the inventive concept.

What is claimed is:

1. An inner body fixing device of a door lock for fixing an inner body of the door lock to an inner surface of a door to attach the inner body to an outer body of the door lock provided on an outer surface of the door, the inner body fixing device comprising:

a first fixing part configured to be fixed on a surface of a door and comprising a first coupling part;

a third fixing part comprising a second coupling part and coupled to the first fixing part by the second coupling part being coupled to the first coupling part; and a second fixing part provided between the first fixing part and the third fixing part, the second fixing part configured to couple to the inner body of the door lock, wherein the first coupling part or the second couplings part extends from a first side of the second fixing part to a second side of the second fixing part, and the first coupling part couples to the second coupling part on the second side of the second fixing part, such that the second fixing part maintains a position between the first fixing part and the third fixing part, and the third fixing part is coupled to the second fixing part by a fixing member such that the second fixing part is firmly fixed between the first fixing part and the third fixing part.

2. The inner body fixing device of a door lock of claim 1, wherein the first coupling part or the second coupling part comprises a first fastening part that receives the first coupling part or the second coupling part such that the third fixing part is coupled to the first fixing part.

3. The inner body fixing device of a door lock of claim 2, wherein the first fastening part is an inlet hole or an inlet groove provided in the first coupling part, and the second coupling part is a protrusion configured to be inserted into the first fastening part.

4. The inner body fixing device of a door lock of claim 2, wherein the first fastening part is an inlet hole or an inlet groove provided in the second coupling part, and the first coupling part is a protrusion configured to be inserted into the first fastening part.

5. The inner body fixing device of a door lock of claim 1, wherein the third fixing part comprises a ring-shaped structure configured to cover an edge surface of the second fixing part.

6. The inner body fixing device of a door lock of claim 1, wherein the second fixing part comprises a second fastening part provided on a lower end of the second fixing part, the second fastening part configured to be fastened to the third fixing part by the fixing member such that the third fixing part is coupled to the second fixing part.

7. The inner body fixing device of a door lock of claim 1, wherein the third fixing part comprises a third fastening part provided on a lower end of the third fixing part, the third fastening part configured to be fastened to the second fixing part by the only one fixing member such that the third fixing part is coupled to the second fixing part.

8. The inner body fixing device of a door lock of claim 1, wherein the second fixing part has a through-hole configured to receive, at the first side of the second fixing part, the first coupling part of the first fixing part such that the first coupling part and the second coupling part couple to each other on the second side of the second fixing part.

9. The inner body fixing device of a door lock of claim 1, wherein an elastic member is provided with the fixing member and is configured to compress and expand between the second fixing part and the third fixing part when the third fixing part is coupled to and decoupled from the second fixing part by the fixing member, respectively.

10. The inner body fixing device of a door lock of claim 1, the third fixing part is coupled to the second fixing part by only one fixing member, the only one fixing member being the fixing member.

* * * * *